US009974357B2

(12) United States Patent
Humble et al.

(10) Patent No.: US 9,974,357 B2
(45) **Date of Patent: *May 22, 2018**

(54) REINFORCING MEMBER FOR ARTICLE OF FOOTWEAR

(71) Applicant: NIKE, Inc., Beaverton, OR (US)

(72) Inventors: Jason P. Humble, Sherwood, OR (US); Cory B. McCullagh, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 106 days.

This patent is subject to a terminal disclaimer.

(21) Appl. No.: 15/221,829

(22) Filed: Jul. 28, 2016

(65) Prior Publication Data

US 2016/0331074 A1 Nov. 17, 2016

Related U.S. Application Data

(63) Continuation of application No. 14/031,510, filed on Sep. 19, 2013, now Pat. No. 9,427,044.
(Continued)

(51) Int. Cl.
*A43B 13/14* (2006.01)
*A43B 13/12* (2006.01)
(Continued)

(52) U.S. Cl.
CPC ..... *A43B 13/141* (2013.01); *A43B 13/026* (2013.01); *A43B 13/04* (2013.01);
(Continued)

(58) Field of Classification Search
CPC ... A43B 13/141; A43B 13/122; A43B 13/026; A43B 13/125; A43B 13/14; A43B 13/22
(Continued)

(56) References Cited

U.S. PATENT DOCUMENTS 362,923 A 5/1887 Baker
1,528,782 A 3/1925 Perry
(Continued)

FOREIGN PATENT DOCUMENTS

CH 246465 A 1/1947
DE 3127793 C1 1/1983
(Continued)

OTHER PUBLICATIONS

International Preliminary Report on Patentability and Written Opinion for Application No. PCT/US2013/060850 , dated Apr. 2, 2015.
(Continued)

*Primary Examiner* — Ted Kavanaugh
(74) *Attorney, Agent, or Firm* — Banner & Witcoff, Ltd.

(57) ABSTRACT

An article of footwear may have a sole including an outer member having an outer surface and an inner surface disposed closer to a wearer's foot than the outer surface. The outer member may include at least a first flex groove formed as an elongate recess in a first flex groove region, causing both the inner surface and the outer surface of the outer member to curve upward. The sole may include a reinforcing member disposed closer to the wearer's foot than the outer member, and may be relatively more rigid than the outer member. The reinforcing member may include a first bridge portion disposed in the first flex groove region and joining the first portion and the second portion together. The lateral width of the first bridge portion may be less than the lateral width of the first portion, and less than the lateral width of the second portion.

13 Claims, 3 Drawing Sheets

Related U.S. Application Data

(60) Provisional application No. 61/704,440, filed on Sep. 21, 2012, provisional application No. 61/704,444, filed on Sep. 21, 2012.

(51) Int. Cl.

| | |
|---|---|
| ***A43B 13/22*** | (2006.01) |
| ***A43B 13/02*** | (2006.01) |
| ***A43B 13/26*** | (2006.01) |
| ***A43B 13/04*** | (2006.01) |
| ***A43B 13/18*** | (2006.01) |
| ***A43C 15/16*** | (2006.01) |

(52) U.S. Cl.
CPC ..... *A43B 13/122* (2013.01); *A43B 13/125* (2013.01); *A43B 13/14* (2013.01); *A43B 13/181* (2013.01); *A43B 13/187* (2013.01); *A43B 13/22* (2013.01); *A43B 13/223* (2013.01); *A43B 13/26* (2013.01); *A43C 15/161* (2013.01); *A43C 15/165* (2013.01)

(58) Field of Classification Search
USPC ..... 36/102, 67 R, 67 A
See application file for complete search history.

(56) References Cited

U.S. PATENT DOCUMENTS

| | | | | |
|---|---|---|---|---|
| 1,560,995 | A | 11/1925 | Kaplan | |
| 1,594,965 | A | 8/1926 | Kaplan | |
| 1,706,478 | A | 3/1929 | Brogan | |
| D171,130 | S | 12/1953 | Gruner | |
| 3,629,962 | A | 12/1971 | Brock | |
| 4,130,947 | A | 12/1978 | Denu | |
| 4,559,723 | A | 12/1985 | Hamy et al. | |
| 4,562,651 | A | 1/1986 | Frederick et al. | |
| 4,586,274 | A | 5/1986 | Blair | |
| 4,670,997 | A | 6/1987 | Beekman | |
| 4,689,901 | A | 9/1987 | Ihlenburg | |
| D293,274 | S | 12/1987 | Igoe | |
| 4,724,624 | A | 2/1988 | Duclos | |
| 4,897,936 | A | 2/1990 | Fuerst | |
| 5,012,597 | A | 5/1991 | Thomasson | |
| 5,203,097 | A | 4/1993 | Blair | |
| 5,313,718 | A | 5/1994 | McMahon et al. | |
| 5,423,135 | A | 6/1995 | Poole et al. | |
| 5,720,118 | A | 2/1998 | Mayer et al. | |
| 5,943,794 | A | 8/1999 | Gelsomini | |
| D415,608 | S | 10/1999 | Gelsomini | |
| 5,987,782 | A * | 11/1999 | Bramani | A43B 3/0057 36/107 |
| 6,016,613 | A | 1/2000 | Campbell et al. | |
| D428,242 | S | 7/2000 | Truelsen | |
| 6,101,746 | A | 8/2000 | Evans | |
| D440,747 | S | 4/2001 | Matis et al. | |
| 6,338,206 | B1 * | 1/2002 | Kita | A43B 7/082 36/29 |
| D455,543 | S | 4/2002 | Feeney et al. | |
| D458,739 | S | 6/2002 | Merceron | |
| D468,515 | S | 1/2003 | Lane, III et al. | |
| D476,143 | S | 6/2003 | McDowell | |
| 6,708,427 | B2 | 3/2004 | Sussmann et al. | |
| 6,748,675 | B2 | 6/2004 | Sato | |
| D504,555 | S | 5/2005 | Urie | |
| D516,781 | S | 3/2006 | Ardissono et al. | |
| 7,143,529 | B2 | 12/2006 | Robinson, Jr. et al. | |
| D542,016 | S | 5/2007 | Teteriatnikov | |
| D550,437 | S | 9/2007 | Belley et al. | |
| D566,935 | S | 4/2008 | Matis et al. | |
| D578,280 | S | 10/2008 | Wilken | |
| D586,991 | S | 2/2009 | Fuerst | |
| D587,437 | S | 3/2009 | McClaskie | |
| 7,513,065 | B2 | 4/2009 | Kita et al. | |
| D591,945 | S | 5/2009 | Belley et al. | |
| D593,291 | S | 6/2009 | Chen | |
| D595,488 | S | 7/2009 | Banik et al. | |
| D604,488 | S | 11/2009 | Amphyon | |
| D605,385 | S | 12/2009 | Andersen et al. | |
| D607,191 | S | 1/2010 | McClaskie | |
| 7,650,707 | B2 | 1/2010 | Campbell et al. | |
| D609,441 | S | 2/2010 | Wawrousek | |
| D609,895 | S | 2/2010 | Andersen et al. | |
| D610,332 | S | 2/2010 | Raichle | |
| D615,740 | S | 5/2010 | Banik et al. | |
| 7,707,748 | B2 * | 5/2010 | Campbell | A43B 5/001 36/102 |
| D618,894 | S | 7/2010 | Tæstensen | |
| 7,818,897 | B2 | 10/2010 | Geer | |
| D631,237 | S | 1/2011 | Genuin et al. | |
| 7,886,461 | B2 * | 2/2011 | Sato | A43B 13/026 36/27 |
| 8,011,118 | B2 | 9/2011 | Gerber | |
| D657,941 | S | 4/2012 | Bramani et al. | |
| 8,166,672 | B2 | 5/2012 | Murphy | |
| D674,170 | S | 1/2013 | Bramani et al. | |
| 8,516,721 | B2 | 8/2013 | Mahoney | |
| 8,516,723 | B2 | 8/2013 | Ferrigan et al. | |
| D700,766 | S | 3/2014 | Bramani | |
| 2004/0205981 | A1 | 10/2004 | Cole | |
| 2006/0042124 | A1 | 3/2006 | Mills et al. | |
| 2006/0059717 | A1 | 3/2006 | Mitchell | |
| 2006/0130361 | A1 | 6/2006 | Robinson et al. | |
| 2006/0242863 | A1 | 11/2006 | Patmore | |
| 2006/0265902 | A1 * | 11/2006 | Kita | A43B 13/10 36/12 |
| 2008/0127523 | A1 | 6/2008 | Hauglin | |
| 2008/0222920 | A1 | 9/2008 | Rovida | |
| 2008/0222921 | A1 | 9/2008 | Gerber | |
| 2009/0038182 | A1 | 2/2009 | Lans et al. | |
| 2009/0113765 | A1 | 5/2009 | Robinson, Jr. et al. | |
| 2009/0249652 | A1 | 10/2009 | Gunthel et al. | |
| 2010/0005684 | A1 * | 1/2010 | Nishiwaki | A43B 7/1425 36/28 |
| 2010/0101116 | A1 | 4/2010 | Serafino et al. | |
| 2010/0269376 | A1 | 10/2010 | Flannery et al. | |
| 2011/0088287 | A1 * | 4/2011 | Auger | A43B 5/02 36/107 |
| 2011/0167672 | A1 | 7/2011 | Bond et al. | |
| 2011/0185590 | A1 | 8/2011 | Nishiwaki et al. | |
| 2011/0197468 | A1 | 8/2011 | Kubo et al. | |
| 2011/0197475 | A1 | 8/2011 | Weidl et al. | |
| 2012/0079747 | A1 * | 4/2012 | Seo | A43B 13/183 36/25 R |
| 2012/0110876 | A1 | 5/2012 | Lubart | |
| 2012/0159816 | A1 | 6/2012 | Wu | |
| 2012/0174433 | A1 | 7/2012 | Mahoney | |
| 2012/0203659 | A1 | 8/2012 | Langvin | |
| 2012/0227285 | A1 | 9/2012 | Adair et al. | |
| 2013/0067765 | A1 * | 3/2013 | Auger | A43B 5/02 36/31 |
| 2013/0086821 | A1 | 4/2013 | Lussier | |
| 2013/0232820 | A1 | 9/2013 | Bramani et al. | |
| 2014/0082968 | A1 | 3/2014 | Binzer | |
| 2014/0082969 | A1 | 3/2014 | Binzer | |
| 2015/0096200 | A1 * | 4/2015 | Healy | A43B 13/122 36/103 |

FOREIGN PATENT DOCUMENTS

| | | | |
|---|---|---|---|
| GB | 191105477 | A | 4/1911 |
| GB | 379872 | A | 9/1932 |
| GB | 1174099 | A | 12/1969 |
| GB | 2223394 | B | 8/1991 |
| IN | 807CHENP2015 | A | 7/2016 |
| WO | 9820763 | | 5/1998 |
| WO | 2009106075 | A1 | 9/2009 |
| WO | 2014047404 | A1 | 3/2014 |
| WO | 2014047419 | A1 | 3/2014 |

(56) References Cited

FOREIGN PATENT DOCUMENTS

OTHER PUBLICATIONS

International Search Report and Written Opinion for Application No. PCT/US2013/060850, dated Mar. 11, 2014.
Patent Examination Report for Australian Application No. 2013317879, dated May 3, 2016, 3 pages.
Patent Examination Report for Australian Application No. 2013317955, dated Jan. 7, 2016.
Response to the First Examination Report filed Apr. 4, 2016 for Australian Application No. 2013317955, dated Jan. 7, 2016, 26 pages.
Voluntary Amendments filed Aug. 18, 2015 in European Patent Application No. 13788801.2.
Response to Patent Examination Report filed Jul. 27, 2016, for Australian Application No. 2013317879.
Response to Patent Examination Report filed Apr. 7, 2016, for Australian Application No. 2013317879.
First Examination Report dated Jan. 7, 2016 for Australian Application No. 2013317955.
Second Examination Report dated May 3, 2016 for Australian Application No. 2013317955.
Response to Second Patent Examination Report filed Jun. 6, 2016, for Australian Application No. 2013317955.
Notice of Acceptance dated Jun. 15, 2016, for Australian Application No. 2013317955.
Examination Report dated Aug. 23, 2016 for Australian Application No. 2013317879.
Response to Examination Report, dated Sep. 5, 2016 for Australian Application No. 2013317879, 24 pages.
International Search Report and Written Opinion dated Mar. 14, 2014, in PCT/US2013/060866.
International Preliminary Report on Patentability (including Written Opinion of the ISA) dated Apr. 2, 2015, in International Application No. PCT/US2013/060866.
Voluntary Amendments filed Aug. 31, 2015, in European Patent Application No. 13788802.01.
Patent Examination Report for Australian Application No. 2013317879, dated Jan. 7, 2016, 3 pp.
Publication of Indian Patent Application No. 809/CHENP/2015, dated Jul. 1, 2016, 1 page.

* cited by examiner

REINFORCING MEMBER FOR ARTICLE OF FOOTWEAR

CROSS-REFERENCE TO RELATED APPLICATIONS

This application is a continuation of U.S. Patent Application Publication No. 2014/0082969, published on Mar. 27, 2014, and entitled "Reinforcing Member for Article of Footwear," which is incorporated herein by reference in its entirety. U.S. Patent Application Publication No. 2014/0082969 claims priority under 35 U.S.C. § 119(e) to U.S. Provisional Patent Application No. 61/704,440, entitled "Reinforcing Member for Article of Footwear," and filed on Sep. 21, 2012, which application is incorporated in its entirety by reference. U.S. Patent Application Publication No. 2014/0082969 also claims priority under 35 U.S.C. § 119(e) to U.S. Provisional Patent Application No. 61/704,444, entitled "Tread Pattern for Article of Footwear," and filed on Sep. 21, 2012, which application is incorporated in its entirety by reference.

BACKGROUND

The present invention relates generally to a reinforcing member for a sole structure of an article of footwear.

Conventional articles of athletic footwear include two primary elements, an upper and a sole structure. The upper provides a covering for the foot that comfortably receives and securely positions the foot with respect to the sole structure. The sole structure is secured to a lower portion of the upper and is generally positioned between the foot and the ground. In addition to attenuating ground reaction forces (that is, providing cushioning) during walking, running, and other ambulatory activities, the sole structure may influence foot motions (for example, by resisting pronation), impart stability, and provide traction, for example. Accordingly, the upper and the sole structure operate cooperatively to provide a comfortable structure that is suited for a wide variety of athletic activities.

The upper is often formed from a plurality of material elements (for example, textiles, polymer sheets, foam layers, leather, synthetic leather) that are stitched or adhesively bonded together to define a void on the interior of the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust fit of the footwear, as well as permit entry and removal of the foot from the void within the upper. In addition, the upper may include a tongue that extends under the lacing system to enhance adjustability and comfort of the footwear, and the upper may incorporate a heel counter.

The sole structure generally incorporates multiple layers: a sockliner, a midsole, and a ground-engaging outer member. The sockliner is a thin, compressible member located within the upper and adjacent to a plantar (that is, lower) surface of the foot to enhance footwear comfort. The midsole is secured to a lower surface of the upper and forms a middle layer of the sole structure. Many midsole configurations are primarily formed from a resilient polymer foam material, such as polyurethane (PU) or ethyl vinyl acetate (EVA), that extends throughout the length and width of the footwear. The midsole may also incorporate plates, moderators, fluid-filled chambers, and/or other elements that further attenuate forces, influence the motions of the foot, and/or impart stability, for example. The ground-engaging outer member may be fashioned from a durable and wear-resistant material (for example, rubber) that includes texturing to improve traction.

Sole structures have been developed that include reinforcing plates. However, the related art lacks provisions for accommodating flexing of various features of a foot. There is a need for articles that address the limitations of the related art.

SUMMARY

In one aspect, the present disclosure is directed to an article of footwear having an upper and a sole. The sole may include an outer member having an outer surface exposed to the ground, the outer member also having an inner surface opposite the outer surface, the inner surface disposed closer to a wearer's foot than the outer surface. The outer member may include at least a first flex groove formed as an elongate recess, the elongate recess causing both the inner surface and the outer surface of the outer member to curve towards the wearer's foot. The first flex groove may define a first flex groove region disposed proximate the first flex groove, the first flex groove also separating a first forefoot region from a second forefoot region. In addition, the sole may further include a reinforcing member attached to the outer member, the reinforcing member being disposed closer to the wearer's foot than the outer member, and the reinforcing member being relatively more rigid than the outer member. Also, the reinforcing member may have a first portion disposed in the first forefoot region, and the reinforcing member may also have a second portion disposed in the second forefoot region. Further, the reinforcing member may include a first bridge portion disposed in the first flex groove region and joining the first portion and the second portion together. The lateral width of the first bridge portion may be less than the lateral width of the first portion, and the lateral width of the first bridge portion may be less than the lateral width of the second portion.

In another aspect, the present disclosure is directed to an article of footwear having an upper and a sole. The sole may include an outer member having an outer surface exposed to the ground, the outer member also having an inner surface opposite the outer surface, the inner surface disposed closer to a wearer's foot than the outer surface when the article of footwear is worn by the wearer. The outer member may include at least a first flex groove formed as an elongate recess in the outer surface of the outer member, the inner surface of the outer member including an upwardly projecting rib formed by the first flex groove. The first flex groove may define a first flex groove region disposed proximate the first flex groove, the first flex groove also separating a first forefoot region from a second forefoot region. The sole may further include a reinforcing member adjacent to the inner surface of the outer member. The reinforcing member may have a first portion disposed in the first forefoot region, a second portion disposed in the second forefoot region, and a first bridge portion disposed in the first flex groove region and joining the first portion and the second portion together. Also, the lateral width of the first bridge portion may be less than the lateral width of the first portion, and the lateral width of the first bridge portion may be less than the lateral width of the second portion. In addition, the first bridge portion may include an upward curvature conforming with a curvature of the upwardly projecting rib formed by the first flex groove.

In another aspect, the present disclosure is directed to an article of footwear having an upper and a sole. The sole may include an outer member having an outer surface exposed to the ground, the outer member also having an inner surface opposite the outer surface, the inner surface disposed closer to a wearer's foot than the outer surface when the article of footwear is worn by the wearer. The outer member may include a flex groove formed as an elongate recess in the outer surface of the outer member, the inner surface of the outer member including an upwardly projecting rib formed by the flex groove in a flex groove region of the outer member. In addition, the sole further may include a reinforcing member adjacent to the inner surface of the outer member. Also, the reinforcing member may have a first portion and a second portion joined by a bridge portion disposed in the flex groove region. The lateral width of the bridge portion may be less than the lateral width of the first portion, wherein the lateral width of the bridge portion may be less than the lateral width of the second portion. Also, the bridge portion may include an upward curvature conforming with a curvature of the upwardly projecting rib formed by the flex groove.

Other systems, methods, features and advantages of the current embodiments will be, or will become, apparent to one of ordinary skill in the art upon examination of the following figures and detailed description. It is intended that all such additional systems, methods, features and advantages be included within this description and this summary, be within the scope of the current embodiments, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
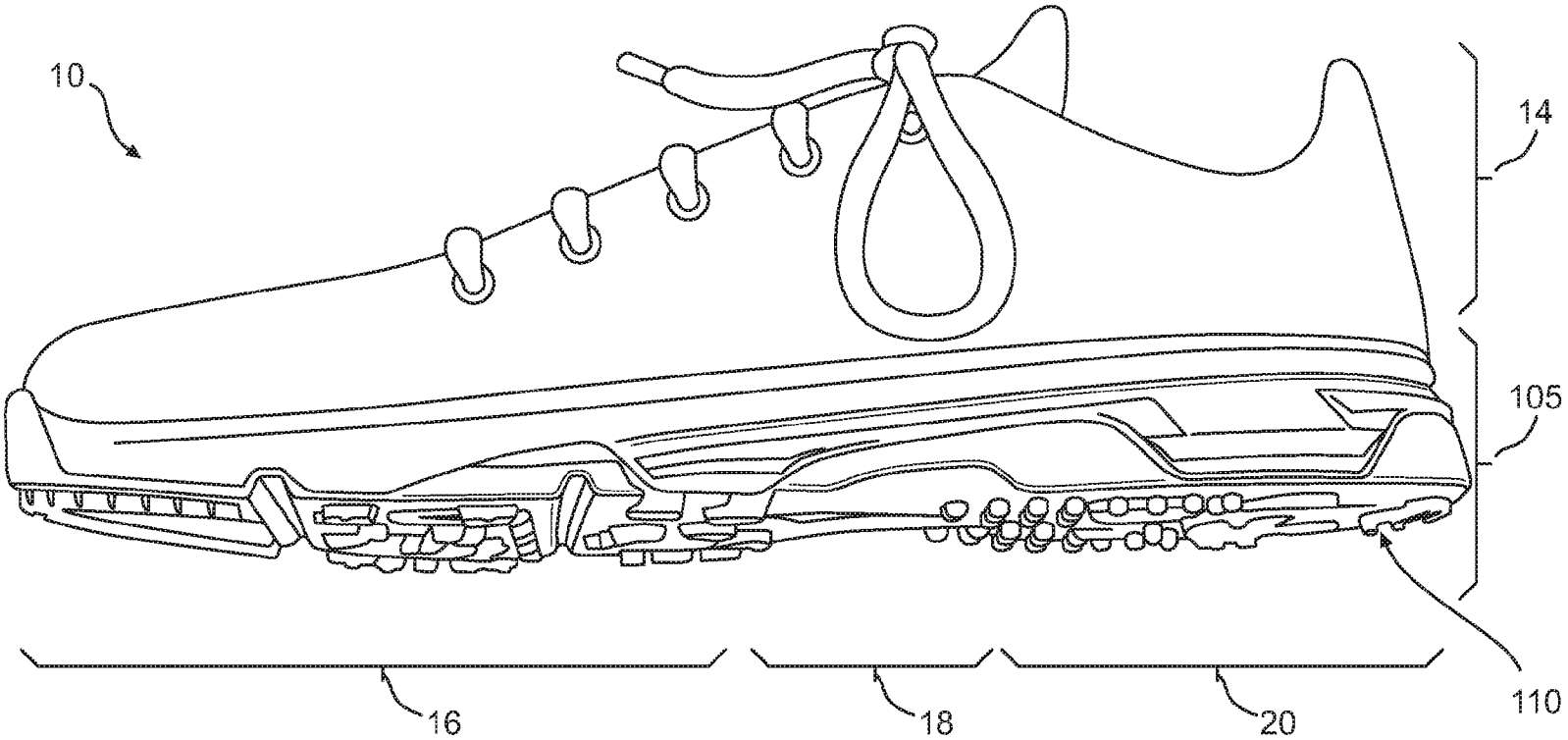
FIG. 1 shows an assembled view of an exemplary article of footwear.

The following discussion and accompanying figures disclose a sole structure for an article of footwear. Concepts associated with the footwear disclosed herein may be applied to a variety of athletic footwear types, including cricket shoes, golf shoes, soccer shoes, running shoes, baseball shoes, basketball shoes, cross-training shoes, cycling shoes, football shoes, golf shoes, tennis shoes, walking shoes, and hiking shoes and boots, for example. Accordingly, the concepts disclosed herein apply to a wide variety of footwear types.

For consistency and convenience, directional adjectives are employed throughout this detailed description corresponding to the illustrated embodiments. The term "longitudinal," as used throughout this detailed description and in the claims, refers to a direction extending a length of a sole structure, i.e., extending from a forefoot portion to a heel portion of the sole. The term "forward" is used to refer to the general direction in which the toes of a foot point, and the term "rearward" is used to refer to the opposite direction, i.e., the direction in which the heel of the foot is facing.

The term "lateral direction," as used throughout this detailed description and in the claims, refers to a side-to-side direction extending a width of a sole. In other words, the lateral direction may extend between a medial side and a lateral side of an article of footwear, with the lateral side of the article of footwear being the surface that faces away from the other foot, and the medial side being the surface that faces toward the other foot.

The term "lateral axis," as used throughout this detailed description and in the claims, refers to an axis oriented in a lateral direction.

The term "horizontal," as used throughout this detailed description and in the claims, refers to any direction substantially parallel with the ground, including the longitudinal direction, the lateral direction, and all directions in between. Similarly, the term "side," as used in this specification and in the claims, refers to any portion of a component facing generally in a lateral, medial, forward, and/or rearward direction, as opposed to an upward or downward direction.

The term "vertical," as used throughout this detailed description and in the claims, refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" refers to the vertical direction heading away from a ground surface, while the term "downward" refers to the vertical direction heading towards the ground surface. Similarly, the terms "top," "upper," and other similar terms refer to the portion of an object substantially furthest from the ground in a vertical direction, and the terms "bottom," "lower," and other similar terms refer to the portion of an object substantially closest to the ground in a vertical direction.

For purposes of this disclosure, the foregoing directional terms, when used in reference to an article of footwear, shall refer to the article of footwear when sitting in an upright position, with the sole facing groundward, that is, as it would be positioned when worn by a wearer standing on a substantially level surface.

In addition, for purposes of this disclosure, the term "fixedly attached" shall refer to two components joined in a manner such that the components may not be readily separated (for example, without destroying one or both of the components). Exemplary modalities of fixed attachment may include joining with permanent adhesive, rivets, stitches, nails, staples, welding or other thermal bonding, and/or other joining techniques. In addition, two components may be "fixedly attached" by virtue of being integrally formed, for example, in a molding process.

FIG. 1 depicts an embodiment of an article of footwear 10, which may include a sole 105 and an upper 14. For reference purposes, footwear 10 may be divided into three general regions: a forefoot region 16, a midfoot region 18, and a heel region 20. Forefoot region 16 generally includes portions of footwear 10 corresponding with the toes and the joints connecting the metatarsals with the phalanges. Midfoot region 18 generally includes portions of footwear 10 corresponding with an arch area of the foot. Heel region 20 generally corresponds with rear portions of the foot, including the calcaneus bone. Regions 16, 18, and 20 are not intended to demarcate precise areas of footwear 10. Rather, regions 16, 18, and 20 are intended to represent general relative areas of footwear 10 to aid in the following discussion.

Since sole 105 and upper 14 both span substantially the entire length of footwear 10, the terms forefoot region 16, midfoot region 18, and heel region 20 apply not only to footwear 10 in general, but also to sole 105 and upper 14, as well as the individual elements of sole structure 105 and upper 14.

Figure 2:
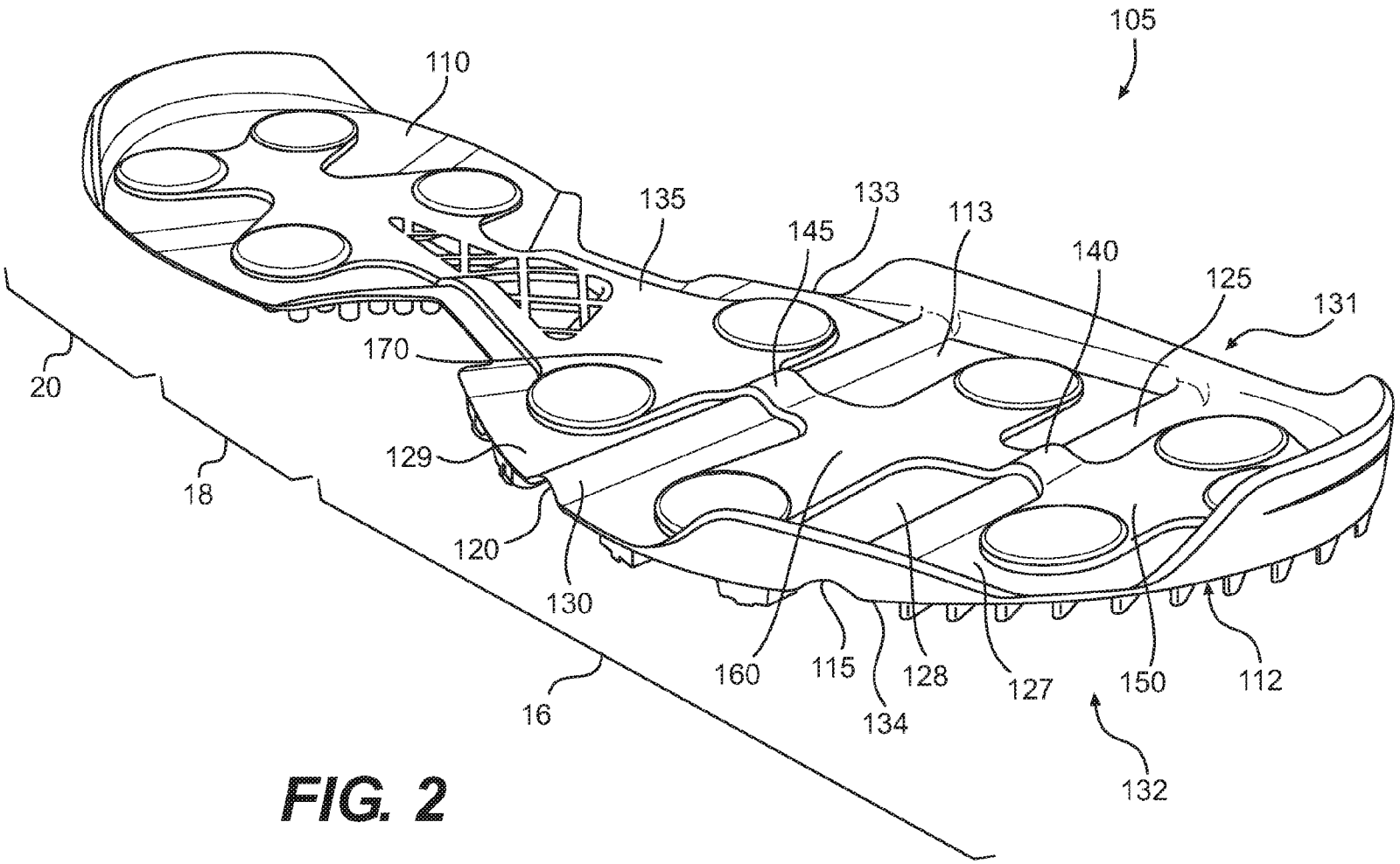
FIG. 2 shows an assembled view of an exemplary sole structure for an article of footwear.

As shown in FIG. 2, sole 105 may be a sole structure, which may include a ground-contacting outer member 110. Outer member 110 may include an outer surface 112 exposed to the ground. Outer member may also have an inner surface 113 opposite outer surface 112, inner surface 113 disposed closer to a wearer's foot than outer surface 112 when the footwear is worn by the wearer.

Outer member 110 may include at least a first flex groove 115, formed as an elongate recess in outer surface 112 of outer member 110. First flex groove 115 may define a first flex groove region 125 disposed proximate first flex groove 115. The elongate recess formed by first flex groove 115 may cause both outer surface 112 and inner surface 113 of outer member 110 to curve towards the wearer's foot when the footwear is worn by a wearer. That is, not only may outer surface 112 be curved upward to form the elongate recess, but also, inner surface 113 of outer member 110 may include an upwardly projecting rib formed by first flex groove 115 in first flex groove region 125.

First flex groove 115 may separate a first forefoot region 127 from a second forefoot region 128. In some embodiments, first flex groove 115 may form a thinner portion of outer member 110 (in a vertical direction) than other portions of outer member 110 (such as first forefoot region 127 and second forefoot region 128), in order to provide increased flexibility of outer member 110 in this area.

In some embodiments, first flex groove 115 may extend in a lateral direction. For example, footwear 10, and therefore outer member 110, may have a medial side 131 and a lateral side 132. As shown in FIG. 2, first flex groove 115 may extend substantially from a medial edge 133 of outer surface 112 of outer member 110 to a lateral edge 134 of outer surface 112 of outer member 110. Further, in some embodiments, first flex groove 115 may extend completely from medial edge 133 to lateral edge 134, as shown in FIG. 2.

Sole 105 may further include a reinforcing member 135 adjacent outer member 110. In some embodiments, reinforcing member 135 may be fixedly attached to outer member 110, for example, by adhesive, welding, fasteners, or other means of mechanical fixation. Reinforcing member 135 may be disposed closer to the wearer's foot than outer member 110 when the footwear is worn by the wearer. In some embodiments, reinforcing member 135 may be relatively more rigid than outer member 110. For example, while outer member 110 may be formed of a rubber or similar material, reinforcing member 135 may be formed of hard plastic, carbon fiber, composite, or other relatively rigid materials.

Reinforcing member 135 may include a first portion 150 disposed in first forefoot region 127, and a second portion 160 disposed in second forefoot region 128. Reinforcing member 135 may also include a first bridge portion 140 disposed in first flex groove region 125 and joining first portion 127 and second portion 128 together.

As shown in FIG. 2, in some embodiments, first bridge portion 140 may match and conform to the curve towards the wearer's foot of first flex groove 115 of outer member 110. That is, first bridge portion 140 may include an upward curvature conforming with the curvature of the upwardly projecting rib formed by first flex groove 115. As shown in FIG. 2, in some embodiments, reinforcing member may have a substantially constant vertical thickness across the first portion 150, the first bridge portion 140, and the second portion 160. That is, the distance between a lower surface 260 and an upper surface 265 of reinforcing member 135 may be substantially the same in first bridge portion 140 and in the adjacent portions of reinforcing member 135. For example, first bridge portion 140 may have a first vertical thickness 270, which may be substantially the same as a second vertical thickness 275 of first portion 150, and which may also be substantially the same as a third vertical thickness 280 of second portion 160. Thus, both a lower surface of reinforcing member 135 and an upper surface of reinforcing member 135 may be curved upward in order to accommodate first flex groove 115.

The configuration of first bridge portion 140 may enable reinforcing member 135 to be positioned lower to the ground than if the entirety of reinforcing member 135 were located at the raised height of first bridge portion 140 in order to clear the upwardly projecting rib of first flex groove 115. This may provide a more stable and/or more responsive sole structure. This also provides more space for midsole structure. For example, because most of reinforcing member 135 is positioned lower to the ground, thicker foam or other cushioning elements may be utilized in the midsole without unduly raising the footbed of the footwear. In addition, a lower position of reinforcing member 135 facilitates use of reinforcing member 135 as an anchoring structure for removable ground engaging members. This feature is discussed in greater detail below.

In some embodiments, outer member 110 may also include a second flex groove 120 defining a second flex groove region 130. Second flex groove 120 may separate second forefoot region 128 from a third forefoot region 129. Second flex groove 120 may form a thinner portion of outer member 110 than other portions of outer member 110, in order to provide increased flexibility of outer member 110 in this area.

In some embodiments, reinforcing member 135 may further include a third portion 170 disposed in third forefoot region 129 and a second bridge portion 145 disposed in second flex groove region 130 and joining second portion 128 and third portion 129 together. In some embodiments, second bridge portion 145 may be configured similarly to first bridge portion 145 described above. For example, second bridge portion 145 may match and conform to the curve towards the wearer's foot of second flex groove 120 of outer member 110. That is, second bridge portion 145 may include an upward curvature conforming with the curvature of the upwardly projecting rib formed by second flex groove 120. In addition, second bridge portion 145 may have substantially the same vertical thickness as second portion 160 and third portion 170 of reinforcing member 135.

Figure 3:
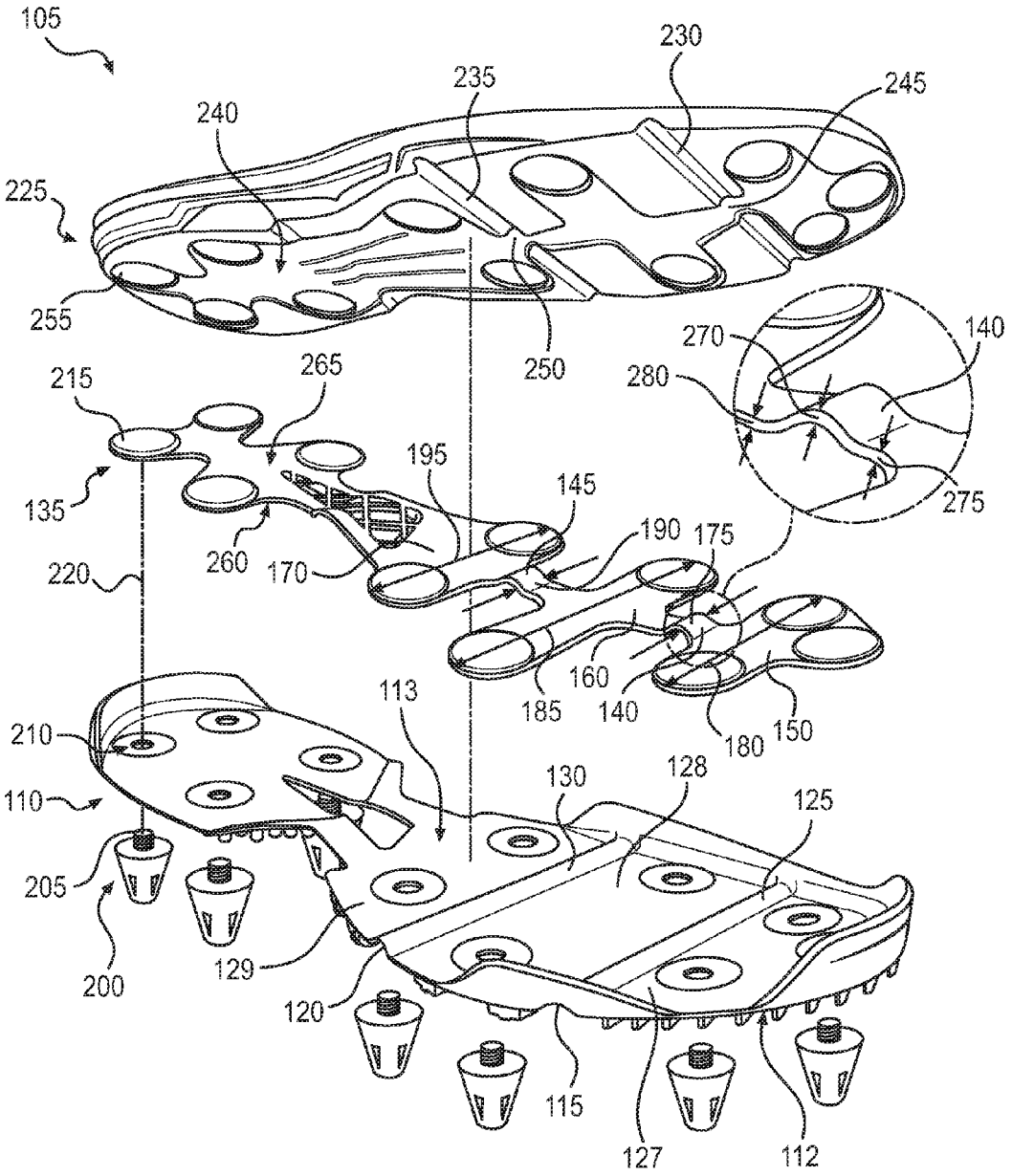
FIG. 3 shows an exploded view of the sole structure shown in FIG. 2.

FIG. 3 shows an exploded view of sole 105. As shown in FIG. 3, in some embodiments, the lateral width 175 of first bridge portion 140 may be less than the lateral width 180 of first portion 150. In addition, the lateral width 175 of first bridge portion 140 may also be less than the lateral width 185 of second portion 160. In some embodiments, material may be removed from reinforcing member 135 proximate first flex groove region 125 in order to reduce the width of reinforcing member 135, which may increase the flexibility of reinforcing member 135 in the area of first bridge portion 140.

In some embodiments, the lateral width 190 of second bridge portion 145 may be less than a lateral width of second portion 160. Further, in some embodiments, the lateral width 190 of second bridge portion 145 may be less than the lateral width 195 of third portion 170. In some embodiments, material may be removed from reinforcing member 135 proximate second flex groove region 130 in order to reduce the width of reinforcing member 135, which may increase the flexibility of reinforcing member 135 in the area of second bridge portion 160.

As further shown in FIG. 3, sole 105 may include removable ground engaging members 200. Ground engaging members 200 are shown in FIG. 3 as having a substantially conical shape. However, any suitable shape may be used for ground engaging members 200. Each ground engaging member 200 may include a threaded portion 205, which may be inserted into a corresponding thru hole 210 in outer member 110. As indicated by axis 220 in FIG. 3, threaded portion 205 of ground engaging member 200 may engage with a receptacle portion 215 of reinforcing member 135. Receptacle portion 215 may include a threaded recess (not shown) on an underside configured to receive threaded portion 205 of ground engaging member 200. As shown in FIG. 3, receptacle portion 215 may include a relatively thicker portion of reinforcing member 135, in order to receive the elongate threaded portion 205 and also to provide further reinforcement of the structure to which ground engaging member 200 is anchored.

Outer surface 112 of outer member 110 may include further ground engaging members arranged in various patterns to provide traction in a manner suitable for various activities. Exemplary such patterns are discussed in detail in Binzer, U.S. Patent Application Publication No. 2014/0082968, published on Mar. 27, 2014, and entitled "Tread Pattern for Article of Footwear," the entire disclosure of which is incorporated herein by reference.

FIG. 3 also shows a midsole 225, which may be disposed adjacent to reinforcing member 135 and, in some locations, adjacent to outer member 110. Midsole 25 may have any suitable configuration. As illustrated in FIG. 3, midsole 225 may include a first midsole flex groove recess 230 configured to receive the upwardly projecting rib formed by first flex groove 115 in outer member 110. Midsole 225 may also include a second midsole flex groove recess 235 configured to receive the upwardly projecting rib formed by second flex groove 120 in outer member 110.

In addition, midsole 225 may also include a recess 240 configured to receive reinforcing member 135. Recess 240 may include concavities configured to receive various aspects of reinforcing member 125. For example, recess 240 may include a first bridge portion recess 245 configured to receive first bridge portion 140 of reinforcing member 135. Recess 240 may also include a second bridge portion recess 250 configured to receive second bridge portion 145 of reinforcing member 135. Further, recess 240 may include a receptacle recess 255 configured to receive receptacle portion 125 of reinforcing member 135.

Sole 105 may include multiple components, which may individually and/or collectively provide footwear 10 with a number of attributes, such as support, rigidity, flexibility, stability, cushioning, comfort, reduced weight, traction, and/or other attributes. Outer member 110 may be formed of suitable materials for achieving the desired performance attributes. Outer member 110 may be formed of any suitable polymer, composite, and/or metal alloy materials. Exemplary such materials may include thermoplastic and thermoset polyurethane, polyester, nylon, polyether block amide, alloys of polyurethane and acrylonitrile butadiene styrene, carbon fiber, poly-paraphenylene terephthalamide (para-aramid fibers, e.g., Kevlar®), titanium alloys, and/or aluminum alloys. In some embodiments, outer member 110 may be fashioned from a durable and wear-resistant material (for example, rubber). Other suitable materials will be recognized by those having skill in the art.

In some embodiments, midsole 225 may be formed of a compressible material, such as a resilient polymer foam material, examples of which may include polyurethane (PU) or ethyl vinyl acetate (EVA) that extends throughout the length and width of the footwear. The midsole may also incorporate plates, moderators, fluid-filled chambers, and/or other elements that further attenuate forces, influence the motions of the foot, and/or impart stability, for example.

While various embodiments of the invention have been described, the description is intended to be exemplary, rather than limiting and it will be apparent to those of ordinary skill in the art that many more embodiments and implementations are possible that are within the scope of the invention. Although many possible combinations of features are shown in the accompanying figures and discussed in this detailed description, many other combinations of the disclosed features are possible. Therefore, it will be understood that any of the features shown and/or discussed in the present disclosure may be implemented together in any suitable combination and that features of one embodiment may be implemented in other disclosed embodiments. Accordingly, the invention is not to be restricted except in light of the attached claims and their equivalents. Also, various modifications and changes may be made within the scope of the attached claims.

What is claimed is:

1. An article of footwear comprising:

an upper and a sole;

the sole comprising an outer member having an outer surface exposed to the ground, the outer member also having an inner surface opposite the outer surface, the inner surface disposed closer to a wearer's foot than the outer surface when the article of footwear is worn by the wearer;

the outer member including at least a first flex groove formed as an elongate recess in the outer surface of the outer member, the inner surface of the outer member including an upwardly projecting rib formed by the first flex groove;

the first flex groove defining a first flex groove region disposed proximate the first flex groove, the first flex groove also separating a first forefoot region from a second forefoot region;

the sole further comprising a reinforcing member adjacent to the inner surface of the outer member;

the reinforcing member having a first portion disposed in the first forefoot region, the reinforcing member also having a second portion disposed in the second forefoot region, and the reinforcing member having a first bridge portion disposed in the first flex groove region and joining the first portion and the second portion together;

wherein the lateral width of the first bridge portion is less than the lateral width of the first portion, and wherein the lateral width of the first bridge portion is less than the lateral width of the second portion; and wherein the first bridge portion includes an upward curvature conforming with a curvature of the upwardly projecting rib formed by the first flex groove; and wherein the reinforcing member is more rigid than the outer member.

2. The article of footwear according to claim 1, wherein the upward curvature of the first bridge portion conforms with the curvature of the upwardly projecting rib formed by the first flex groove over an entirety of the lower surface area of the first bridge portion.

3. The article of footwear according to claim 1, further comprising a second flex groove defining a second flex groove region, the second flex groove separating the second forefoot region from a third forefoot region, the second flex groove forming an elongate recess in the outer surface of the outer member and an upwardly projecting rib in the inner surface of the outer member;

wherein the reinforcing member further comprises a third portion disposed in the third forefoot region and a second bridge portion disposed in the second flex groove region and joining the second portion and the third portion together.

4. The article of footwear according to claim 3, wherein the lateral width of the second bridge portion is less than the lateral width of the second portion, and wherein the lateral width of the second bridge portion is less than the lateral width of the third portion.

5. The article of footwear according to claim 4, wherein the second bridge portion has an upward curvature conforming with a curvature of the upwardly projecting rib formed by the second flex groove.

6. The article of footwear according to claim 1, wherein the first flex groove extends in a lateral direction.

7. The article of footwear according to claim 6, wherein the first flex groove extends substantially from a medial edge of the outer surface of the outer member to a lateral edge of the outer surface of the outer member.

8. The article of footwear according to claim 1, wherein the reinforcing member is more rigid than the outer member.

9. An article of footwear comprising:

an upper and a sole;

the sole comprising an outer member having an outer surface exposed to the ground, the outer member also having an inner surface opposite the outer surface, the inner surface disposed closer to a wearer's foot than the outer surface when the article of footwear is worn by the wearer;

the outer member including a flex groove formed as an elongate recess in the outer surface of the outer member, the inner surface of the outer member including an upwardly projecting rib formed by the flex groove in a flex groove region of the outer member;

the sole further comprising a reinforcing member adjacent to the inner surface of the outer member;

the reinforcing member having a first portion and a second portion joined by a bridge portion disposed in the flex groove region;

wherein the lateral width of the bridge portion is less than the lateral width of the first portion, and wherein the lateral width of the bridge portion is less than the lateral width of the second portion;

wherein the bridge portion includes an upward curvature conforming with a curvature of the upwardly projecting rib formed by the flex groove; and wherein the reinforcing member is more rigid than the outer member.

10. The article of footwear according to claim 9, wherein the flex groove extends in a lateral direction.

11. The article of footwear according to claim 10, wherein the flex groove extends substantially completely across a forefoot region of the sole.

12. The article of footwear according to claim 9, wherein the reinforcing member is more rigid than the outer member.

13. The article of footwear according to claim 9, wherein the upward curvature of the bridge portion conforms with the curvature of the upwardly projecting rib formed by the flex groove over an entirety of the lower surface area of the bridge portion.

* * * * *